US009487731B2

(12) United States Patent
Ruhe, Jr.

(10) Patent No.: US 9,487,731 B2
(45) Date of Patent: Nov. 8, 2016

(54) FUNCTIONALIZED OLEFIN COPOLYMERS WITH MONOAMINE TERMINATED POLYETHER AND LUBRICATING OIL COMPOSITIONS

(71) Applicant: Chevron Oronite Company LLC, San Ramon, CA (US)

(72) Inventor: William Raymond Ruhe, Jr., Benicia, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 14/930,727

(22) Filed: Nov. 3, 2015

(65) Prior Publication Data

US 2016/0145530 A1 May 26, 2016

Related U.S. Application Data

(62) Division of application No. 13/720,689, filed on Dec. 19, 2012, now Pat. No. 9,347,015.

(60) Provisional application No. 61/581,367, filed on Dec. 29, 2011.

(51) Int. Cl.

| | |
|---|---|
| ***C10L 1/22*** | (2006.01) |
| ***C10M 159/12*** | (2006.01) |
| ***C10M 133/06*** | (2006.01) |
| ***C10M 133/54*** | (2006.01) |
| ***C10M 133/56*** | (2006.01) |
| ***C10M 147/00*** | (2006.01) |
| ***C10M 169/04*** | (2006.01) |

(52) U.S. Cl.

CPC ..... *C10M 159/12* (2013.01); *C10M 133/06* (2013.01); *C10M 133/54* (2013.01); *C10M 133/56* (2013.01); *C10M 147/00* (2013.01); *C10M 169/042* (2013.01); *C10M 2203/1025* (2013.01); *C10M 2205/022* (2013.01); *C10M 2207/028* (2013.01); *C10M 2215/28* (2013.01); *C10M 2217/06* (2013.01); *C10M 2219/046* (2013.01); *C10M 2223/045* (2013.01); *C10N 2210/02* (2013.01); *C10N 2220/021* (2013.01); *C10N 2220/022* (2013.01); *C10N 2220/033* (2013.01); *C10N 2230/02* (2013.01); *C10N 2230/041* (2013.01); *C10N 2230/06* (2013.01); *C10N 2240/102* (2013.01); *C10N 2240/103* (2013.01)

(58) Field of Classification Search

USPC ..... 508/238

See application file for complete search history.

(56) References Cited

U.S. PATENT DOCUMENTS

| | | | | |
|---|---|---|---|---|
| 2,421,837 | A | | 6/1947 | Hardman |
| 2,782,240 | A | | 2/1957 | Hefner et al. |
| 2,841,479 | A | | 7/1958 | Hefner et al. |
| 2,974,160 | A | | 3/1961 | Heininger |
| 3,654,370 | A | | 4/1972 | Yeakey |
| 3,862,265 | A | | 1/1975 | Steinkamp et al. |
| 4,152,353 | A | | 5/1979 | Habermann |
| 4,160,739 | A | | 7/1979 | Stambaugh et al. |
| 4,247,301 | A | | 1/1981 | Honnen |
| 4,332,595 | A | | 6/1982 | Herbstman et al. |
| 4,618,717 | A | | 10/1986 | Renken et al. |
| 4,632,769 | A | | 12/1986 | Gutierrez |
| 4,735,736 | A | * | 4/1988 | Chung ..... C10M 145/16 508/221 |
| 4,766,245 | A | | 8/1988 | Larkin et al. |
| 4,863,623 | A | | 9/1989 | Nalesnik |
| 4,960,942 | A | | 10/1990 | Gerkin et al. |
| 4,973,761 | A | | 11/1990 | Schoenleben et al. |
| 5,003,107 | A | | 3/1991 | Zimmerman et al. |
| 5,043,083 | A | | 8/1991 | Colcord et al. |
| 5,075,383 | A | | 12/1991 | Migdal et al. |
| 5,112,634 | A | | 5/1992 | Swearingen |
| 5,160,446 | A | | 11/1992 | Nalesnik et al. |
| 5,352,835 | A | | 10/1994 | Dai et al. |
| 5,422,042 | A | | 6/1995 | Waddill et al. |
| 5,429,757 | A | | 7/1995 | Mishra et al. |
| 5,457,147 | A | | 10/1995 | McGrath et al. |
| 5,540,851 | A | | 7/1996 | Lange |
| 5,837,773 | A | | 11/1998 | Olivier et al. |
| 6,107,257 | A | | 8/2000 | Valcho et al. |
| 7,960,320 | B2 | | 6/2011 | Covitch et al. |
| 2003/0150154 | A1 | | 8/2003 | Cherpeck |

* cited by examiner

*Primary Examiner* — Monique Peets
(74) *Attorney, Agent, or Firm* — Thomas P. Weber

(57) ABSTRACT

A method for is disclosed for improving diesel engine wear by lubricating the engine with a composition comprising an oil of lubricating viscosity and based upon the total composition of the lubricating oil composition from about 0.1 to about 2.0 weight % actives of a reaction product of an ethylene-alpha olefin copolymer acylated with maleic anhydride having a number average molecular weight from 5,000 to 120,000 and a hydrocarbyl-substituted poly(oxyalkylene) monoamine represented by the formula: $R_1$—$(OCH_2CH_2)_f$—$(OCH_2CHR_4)_g$—$NHR_5$ wherein $R_1$ a hydrocarbyl group having from about 1 to about 35 carbon atoms; $R_4$ is independently hydrogen or methyl for each repeat unit g; $R_5$ is hydrogen or alkyl from 1 to 10 carbon atoms; and f and g are integers such that f+g is from 2 to 45 and wherein $R_4$ is selected to have a plurality of ethylene oxide in the polyoxyalkylene moiety.

12 Claims, No Drawings

FUNCTIONALIZED OLEFIN COPOLYMERS WITH MONOAMINE TERMINATED POLYETHER AND LUBRICATING OIL COMPOSITIONS

This application is a divisional application of co-pending application Ser. No. 13/720,689, filed Dec. 19, 2012 and claims priority therefrom.

FIELD OF THE INVENTION

The present disclosure relates to functionalized olefin copolymers as additives in synthetic and petroleum oils, particularly lubricating oils.

BACKGROUND

Hydrocarbon polymers, particularly ethylene-alpha olefin copolymers, are in widespread use as viscosity index (V.I.) improving additives for oil compositions, particularly lubricating oil compositions. A substantial body of prior art exists directed towards further reacting these ethylene-alpha olefin copolymer V.I. improvers to form a multi-functional V.I. improver. This dispersant V.I. Improver additive is used to improve not only the V.I. properties of the oil but to also impart dispersancy so as to suspend soot or sludge that may form during the operation or use of the lubricant in engines. Various patents teach grafting ethylene-alpha olefin copolymers with maleic anhydride, followed by reaction with an amine. A number of these prior disclosures teach reducing or avoiding the use of polyamine having two primary amine groups to thereby reduce cross-linking problems which become more of a problem as the number of amine moieties added to the polymer molecule is increased in order to increase dispersancy. Generally, these patents used a primary-tertiary amine.

U.S. Pat. No. 4,160,739, issued Jul. 10, 1979, to Stambaugh et al. discloses graft copolymers wherein the backbone polymer is a polymeric hydrocarbon such as substantially linear ethylene-propylene copolymer and the grafted units are the residues of a monomer system comprising maleic acid or anhydride and one or more other monomers copolymerizable therewith, the monomer system being post-reacted with a polyamine compound comprising a primary or secondary amine. The graft copolymers impart combined, detergent, viscosity index improvement and other useful properties to lubricating oils and hydrocarbon motor fuels.

U.S. Pat. No. 4,735,736, issued Apr. 5, 1988, to Chung discloses oil-soluble ethylene-alpha olefin hydrocarbon polymers, useful as V.I. improvers, such as ethylene-alpha olefin copolymer, preferably ethylene-propylene copolymer, grafted with an unsaturated acid material, such as maleic anhydride, preferably by solid state grafting followed by reaction with a polyamine, preferably a tertiary-primary amine, and treatment and/or reaction with aliphatic monoamine. The resulting material is used in oil compositions, such as lubricating oil, as a viscosity index improver having sludge dispersancy properties. The monoamine treatment inhibits viscosity growth of the additive upon storage.

U.S. Pat. No. 4,863,623, issued Sep. 5, 1989, to Nalesnik discloses an additive composition comprising a graft and an amine-derivatized copolymer prepared from ethylene and at least one $C_3$ to $C_{10}$ alpha-monoolefin and, optionally, a polyene selected from non-conjugated dienes and trienes comprising from about 15 to 80 mole % of ethylene, from about 20 to 85 mole % of the $C_3$ to $C_{10}$ alpha-monoolefin and from about 0 to 15 mole % of the polyene having a average molecular weight ranging from about 5,000 to 500,000 which has been reacted with at least one olefinic carboxylic acid acylating agent to form one or more acylating reaction intermediates characterized by having a carboxylic acid acylating group within their structure and reacting the reaction intermediate with an amino-aromatic polyamine compound from the group consisting of an N-arylphenylenediamine, an aminothiazole, an aminocarbazole, an aminoindole, an aminopyrrole, an amino-indazolinone, an aminomercaptotriazole and an aminopyrimidine to form the graft and amine-derivatized copolymer. A lubricating oil composition containing the amine-derivatized copolymer is also disclosed.

U.S. Pat. No. 5,429,757, issued Jul. 4, 1995, and U.S. Pat. No. 5,563,118, issued Oct. 8, 1996, to Mishra et al. disclose an additive composition comprising a graft and derivatized copolymer prepared from ethylene and at least one $C_3$ to $C_{10}$ alpha-monoolefin and, optionally, a polyene selected from non-conjugated dienes and trienes comprising from about 15 to 80 mole % of ethylene, from about 20 to 85 mole % of the $C_3$ to $C_{10}$ alpha-monoolefin and from about 0 to 15 mole % of the polyene having an average molecular weight ranging from about 5,000 to 500,000, which has been reacted with at least one olefinic (carboxylic acid acylating agent to form one or more acylating reaction intermediates characterized by having a carboxylic acid acylating group within their structure and reacting the reaction intermediate with an amino-aromatic compound to form the graft derivatized copolymer.

U.S. Pat. No. 6,107,257, issued Aug. 22, 2000, to Valcho et al. discloses a additive comprising a highly grafted, multi-functional olefin copolymer comprising a graft and amine-derivatized copolymer prepared from ethylene and at least one $C_3$ to $C_{23}$ alpha-monoolefin and, optionally, a polyene, wherein the copolymer of ethylene and at least one $C_3$ to $C_{23}$ alpha-monoolefin has grafted thereon from 0.3 to 0.75 carboxylic groups per 1,000 number average molecular weight units of olefin copolymer and wherein the olefin copolymer has a number average molecular weight of between 20,000 and 150,000.

SUMMARY

One aspect is directed to an oil soluble reaction product, useful as a lubricating oil additive, comprising the product of:

a) an oil soluble ethylene-alpha olefin copolymer comprising from 10 to less than 80 weight % ethylene and greater than 20 up to 90 weight % of at least one $C_3$ to $C_{28}$ alpha olefins, having a number average molecular weight from about 5,000 to 120,000 and grafted with 0.5 to 5 weight % of an ethylenically unsaturated acylating agent having at least one carboxylic acid group or anhydride group, with b) a hydrocarbyl substituted poly(oxyalkylene) monoamine of the formula:

$$R_1—(O—CHR_2—CHR_3)_x\text{-}A$$

wherein $R_1$ is a hydrocarbyl group having from about 1 to about 35 carbon atoms;

$R_2$ and $R_3$ are each independently hydrogen, methyl, or ethyl and each $R_2$ and $R_3$ are independently selected in each —O—$CHR_2$—$CHR_3$— unit;

A is amino, —$CH_2$amino or N-alkyl amino having about 1 to 10 carbon atoms; and x is an integer from about 2 to about 45.

In this regard, one aspect is directed to wherein the oil soluble ethylene-alpha olefin copolymer comprises from 35 to less than 60 weight % ethylene and greater than 40 up to 65 weight % of at least one $C_3$ to $C_{28}$ alpha olefins. More specifically, wherein the oil soluble ethylene-alpha olefin copolymer comprises from 45 to less than 55 weight % ethylene and greater than 45 up to 55 weight % of at least one $C_3$ to $C_{12}$ alpha olefins or wherein the at least one alpha olefins is at least one $C_3$ to $C_8$ alpha olefin. Suitable copolymers may be predominately ethylene-propylene copolymers, i.e. being >98% of ethylene-propylene.

A further aspect is directed to wherein the oil soluble ethylene-alpha olefin copolymer comprises from 10 to less than 20 weight % ethylene and greater than 80 up to 90 weight % of propylene. These ethylene-propylene copolymers with relatively high propylene content may be selected at lower shear stability index (SSI) and one aspect is directed to SSI <24 for example SSI from about 6 to 20. In one aspect, the oil soluble reaction product of the oil soluble ethylene-alpha olefin copolymer is grafted with 0.6 to 3 weight % of an ethylenically unsaturated acylating agent having at least one carboxylic acid group or anhydride group. Particularly suited ethylenically unsaturated acylating agents selected from the group consisting of acrylic, methacrylic, cinnamic, crotonic, maleic, fumaric and itaconic reactants or a mixture thereof with maleic anhydride being well suited.

Particularly suited hydrocarbyl substituted poly(oxyalkylene) monoamines include wherein $R_1$ is selected from the group consisting of alkyl, aryl, alkyaryl, arylalkyl, and arylalkylaryl. One aspect is directed to wherein $R_1$ is alkyl from 1-10 carbon atoms such as being selected from the group consisting of methyl, ethyl, propyl, and butyl. $R_1$ may also be selected from the group consisting phenyl, naphthyl, alkylnapthyl, and substituted phenyl having one to three substituents selected from alkyl, aryl, alkylaryl, arylalkyl. In this regard, $R_1$ is selected from the group consisting of phenyl, alkylphenyl, naphthyl and alkylnaphthyl.

Another aspect is directed to a lubricating oil composition comprising any one of the embodiments described herein above for the oil soluble ethylene-alpha olefin copolymer product with a hydrocarbyl substituted poly(oxyalkylene) monoamine of the formula in a minor amount and a major amount of an oil of lubricating viscosity. Thus this aspect is directed towards lubricating oil comprising a major amount of an oil of lubricating viscosity and a minor amount of the reaction product of:

a) an oil soluble ethylene-alpha olefin copolymer comprising from 10 to less than 80 weight % ethylene and greater than 20 up to 90 weight % of at least one $C_3$ to $C_{28}$ alpha olefins, having a number average molecular weight from about 5,000 to 120,000 and grafted with 0.5 to 5 weight % of an ethylenically unsaturated acylating agent having at least one carboxylic acid group or anhydride group, with b) a hydrocarbyl substituted poly(oxyalkylene) monoamine of the formula:

$$R_1—(O—CHR_2—CHR_3)_x\text{-}A$$

wherein $R_1$ is a hydrocarbyl group having from about 1 to about 35 carbon atoms;

$R_2$ and $R_3$ are each independently hydrogen, methyl, or ethyl and each $R_2$ and $R_3$ are independently selected in each —O—$CHR_2$—$CHR_3$— unit;

A is amino, —$CH_2$amino or N-alkyl amino having about 1 to 10 carbon atoms; and x is an integer from about 2 to about 45.

Another aspect is directed towards a method for improving diesel engine wear by lubricating said engine with a composition comprising an oil of lubricating viscosity and based upon the total composition of the lubricating oil composition about 0.1 to about 2.0 weight % actives of the reaction product of a maleated ethylene-alpha olefin copolymer having a number average molecular weight from 5,000 to 120,000 and an hydrocarbyl-substituted poly(oxyalkylene) monoamine can be represented by the formula:

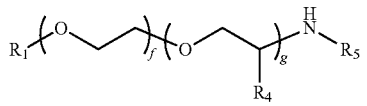

wherein:

$R_1$ a hydrocarbyl group having from about 1 to about 35 carbon atoms;

$R_4$ is independently hydrogen or methyl for each repeat unit g, $R_5$ is hydrogen or alkyl from 1 to 10 carbon atoms; and f and g are integers such that f+g is from 2 to 45 and wherein $R_4$ is selected to have a plurality of ethylene oxide in the poly(oxyalkylene) moiety.

In another aspect, is directed to an oil soluble reaction product, useful as a lubricating oil additive, comprising the product of: a) an oil soluble ethylene-alpha olefin terpolymer comprising from 10 to less than 80 weight % ethylene and greater than 20 up to 90 weight % of at least one $C_3$ to $C_{28}$ alpha olefins and up to about 3 weight % of a nonconjugated diene or triene, said terpolymer having a number average molecular weight from about 5,000 to 120,000 and grafted with 0.5 to 5 weight % of an ethylenically unsaturated acylating agent having at least one carboxylic acid group or anhydride group, with b) a hydrocarbyl substituted poly (oxyalkylene) monoamine of the formula: $R_1$—(O—$CHR_2$—$CHR_3)_x$-A; wherein $R_1$ is a hydrocarbyl group having from about 1 to about 35 carbon atoms; $R_2$ and $R_3$ are each independently hydrogen, methyl, or ethyl and each $R_2$ and $R_3$ are independently selected in each —O—$CHR_2$—$CHR_3$— unit; A is amino, —$CH_2$amino or N-alkyl amino having about 1 to 10 carbon atoms; and x is an integer from about 2 to about 45.

DETAILED DESCRIPTION

The ethylene-alpha olefin copolymer substrate or polymer backbone starting material for use in one embodiment of the present disclosure preferably comprises copolymers of ethylene and one or more $C_3$ to $C_{28}$ alpha olefins. Preferably the alpha olefin is from $C_3$ to $C_{20}$ and more preferably less than $C_{12}$. Copolymers of ethylene and propylene are most preferred. Another aspect is directed to copolymers of ethylene and octene. Another aspect is directed to copolymers of ethylene and 1-butene. "Copolymers" herein can include without limitation blends or reacted products of ethylene and one or more $C_3$ to $C_{28}$ alpha olefins, and additionally optionally other non-conjugated dienes or polyenes. Thus, "copolymers" herein also includes terpolymers, and other higher forms. Other alpha olefins suitable in place of propylene to form the copolymer or to be used in combination with ethylene and propylene to form a terpolymer include 1-butene, 1-pentene, 1-hexene, 1-octene; non-conjugated diolefins such as 1,5-hexadiene, 1,6-heptadiene, 1,7-octadiene, dicyclopendadiene, 5-ethylidene-2-norbornene, 5-methylene-2-norbornene; branched chain alpha olefins such as 4-methylbutene-1,5-methylpentene-1 and 6-methylheptene-1; and mixtures thereof. The triene component will have at least two non-conjugated double bonds, and up to about 30 carbon atoms in the chain. Typical trienes useful in preparing the interpolymer of the present invention are 1-isopropylidene-3a,4,7,7a-tetrahydroindene, 1-isopropylidenedicyclopentadiene, dehydro-isodicyclopentadiene, and 2-(2-methylene-4-methyl-3-pentenyl[2.2.1]bicycle-5-heptene.

Ethylene-propylene or ethylene-higher alpha olefin copolymers may consist of from about 10 to less than 80 weight percent ethylene and from about 20 up to 90 weight percent $C_3$ to $C_{28}$ alpha olefin with the weight ratios in one embodiment being from about 35 to less than 60 weight percent ethylene and from about 40 to 65 weight percent of a $C_3$ to $C_{28}$ alpha olefin, with the proportions in another embodiment being from 45 to 55 weight percent ethylene and 55 to 45 weight percent $C_3$ to $C_{28}$ alpha olefin. In another aspect is directed ethylene-propylene copolymers may consist of from about 10 to less than 20 weight percent ethylene and from about 80 up to 90 weight percent propylene.

Terpolymer variations of the foregoing polymers may contain from about 0 to 10 weight percent and more preferably from about 0 to about 3 weight percent of a nonconjugated diene or triene. In one aspect, the foregoing polymers will not contain any non-conjugated diene or triene.

The starting polymer substrate, that is the ethylene-alpha olefin copolymer or terpolymer, is an oil-soluble, linear or branched polymer having a number average molecular weight from about 5,000 to 250,000, and, more particularly having a number average molecular weight from 5,000 to 120,000, as determined by gel permeation chromatography.

The term "polymer" is used generically to encompass ethylene-alpha olefin copolymers, terpolymers or interpolymers. These materials may contain amounts of other olefinic monomers so long as the basic characteristics of the polymers are not materially changed.

The polymerization reaction used to form an ethylene-alpha olefin copolymer can generally be carried out in the presence of a Ziegler-Natta or metallocene catalyst system. The polymerization medium is not specific and can include solution, slurry, or gas phase processes, as known to those skilled in the art. When solution polymerization is employed, the solvent may be any suitable inert hydrocarbon solvent that is liquid under reaction conditions for polymerization of alpha olefins; examples of satisfactory hydrocarbon solvents include straight chain paraffins having from 5 to 8 carbon atoms, with hexane being preferred. Aromatic hydrocarbons, preferably aromatic hydrocarbon having a single benzene nucleus, such as benzene, toluene and the like; and saturated cyclic hydrocarbons having boiling point ranges approximating those of the straight chain paraffinic hydrocarbons and aromatic hydrocarbons described above are particularly suitable. The solvent selected may be a mixture of one or more of the foregoing hydrocarbons. It is desirable that the polymerization medium be free of substances that will interfere with the catalyst components.

The polymer substrate, i.e., the ethylene-alpha olefin polymer component, generally can be conveniently obtained in the form of bale, ground or pelletized polymer. The olefin polymer can also be supplied as either a bale or a pre-mixed friable chopped agglomerate form.

In one embodiment, ground polymer bales or other forms of the olefin copolymer are fed to an extruder, e.g., a single or twin screw extruder, or a Banbury or other mixer having the capability of heating and effecting the desired level of mechanical work (agitation) on the polymer substrate for the dehydration step. A nitrogen blanket can be maintained at the feed section of the extruder to minimize the introduction of air.

The olefin copolymer is typically heated before being admixed with any other reactants in the extruder or other mixer with venting to eliminate moisture content in the feed material. The dried olefin copolymer is in one embodiment then fed into another extruder section or separate extruder in series for conducting the grafting reaction.

Grafting Procedure: Acylating Agents-Graft Monomers

A graft monomer is next grafted onto the polymer backbone of the polymer substrate to form an acylated ethylene-alpha olefin copolymer. Suitable graft monomers include ethylenically unsaturated acylating agents, such as unsaturated dicarboxylic acid anhydrides and their corresponding acids. These carboxylic reactants which are suitable for grafting onto the ethylene-alpha olefin interpolymers contain at least one ethylenic bond and at least one carboxylic acid or its anhydride groups or a polar group which is convertible into said carboxyl groups by oxidation or hydrolysis. The carboxylic reactants are selected from the group consisting of acrylic, methacrylic, cinnamic, crotonic, maleic, fumaric and itaconic reactants or a mixture of two or more of these. In the case of unsaturated ethylene-alpha olefin copolymers or terpolymers, itaconic acid or its anhydride is useful due to its reduced tendency to form a cross-linked structure during the free-radical grafting process.

In one aspect, the ethylenically unsaturated acylating agent can be represented by formula (A) and/or formula (B):

(A)

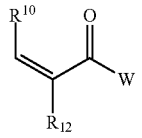

(B)

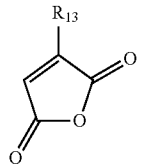

wherein $R_{10}$ is hydrogen or —CO—W', $R_{12}$ and $R_{13}$ are independently hydrogen or —$CH_3$; and W and W' are independently —OH, or alkoxyl having 1 to about 24 carbon atoms. Maleic anhydride or a derivative thereof is the preferred ethylenically unsaturated acylating agent.

The ethylenically unsaturated acylating agent may be grafted onto the copolymer backbone in a number of ways. It may be grafted onto the backbone by a thermal process known as the "ene" process or by grafting in solution or in melt form using a free-radical initiator. The free-radical induced grafting of ethylenically unsaturated acylating agents may carried out in solvents, such as hexane, heptane, mineral oil, or aromatic solvents, it is carried out at an elevated temperature in the range of about 100° C. to about 300° C., preferably about 120° C. to about 240° C. and more preferably at about 150° C. to about 200° C., e.g. above 160° C., in a solvent preferably a mineral oil solution containing, e.g. about 1 wt % to about 50 wt %, preferably about 5 wt % to about 30 wt %, based on the initial total oil solution, of the ethylene-alpha olefin copolymer and preferably under an inert environment.

The ethylenically unsaturated acylating agents typically can provide one or two carboxylic groups per mole of reactant to the grafted copolymer. That is, methyl methacrylate can provide one carboxylic group per molecule to the grafted copolymer while maleic anhydride can provide two carboxylic groups per molecule to the grafted copolymer.

Free-Radical Initiator

The grafting reaction to form the acylated olefin copolymers is in one embodiment generally carried out with the aid of a free-radical initiator either in bulk or in solution. The grafting can be carried out in the presence of a free-radical initiator dissolved in oil. The use of a free-radical initiator dissolved in oil results in a more homogeneous distribution of acylated groups over the olefin copolymer molecules.

The free-radical initiators which may be used to graft the ethylenically unsaturated acylating agents to the polymer backbone include peroxides, hydroperoxides, peresters, and also azo compounds and preferably those which have a boiling point greater than 100 and decompose thermally within the grafting temperature range to provide free radicals. Representatives of these free-radical initiators are peroxides (diacyl peroxides such as benzoyl peroxide, dialkyl peroxides such as 1,1-bis(tert-butylperoxy)cyclohexane. 1,1-bis(tert-butylperoxy)-3,3,5-trimethylcyclohexane, 2,2-bis(tert-butylperoxy)butane, dicumylperoxide, tert-butylcumylperoxide, bis(tert-butylperoxyisopropyl)benzene, di-tert-butylperoxide (DTBP), 2,5-dimethyl-2,5-di(tert-butylperoxy)hexane, 2,5-dimethyl-2,5-di(tert-butylperoxy)-hexyne), hydroperoxides, peroxyesters such as tert-butyl peroxy benzoate, tert-butylperoxy acetate, O,O-tert-butyl-O-(2-ethylhexyl)monoperoxy carbonate, peroxyketals such as n-butyl 4,4-di-(tert-butylperoxy)valerate and the like. The initiator is used in an amount of between about 0.005% and about 1% by weight based on the weight of the reaction mixture solution. The grafting is preferably carried out in an inert atmosphere, such as under nitrogen blanketing. The resulting polymer intermediate is characterized by having acylating groups, typified by a carboxylic acid or acid chloride, within its structure.

Grafting Reaction Equipment and Conditions

To perform the grafting reaction as a solvent-free or essentially solvent-free bulk process, the graft monomer and olefin copolymer are in one embodiment fed to an extruder, e.g., a single or twin screw extruder e.g. Werner & Pfleiderer's ZSK series, or a Banbury or other mixer, having the capability of heating and effecting the desired level of mechanical work (agitation) on the reactants for the grafting step. In one embodiment, grafting is conducted in an extruder, and particularly a twin screw extruder. A nitrogen blanket is maintained at the feed section of the extruder to minimize the introduction of air. Alternatively, the olefinic carboxylic acylating agent can be injected at one injection point, or is may be injected at two injection points in a zone of the extruder without significant mixing e.g. a transport zone. This often results in an improved efficiency of the grafting and leads to lower gel content.

Suitable extruders are generally known available for conducting grafting, and the prior dehydration procedure. The dehydration of the polymer substrate and subsequent grafting procedures can be performed in separate extruders set up in series. Alternatively, a single extruder having multiple treatment or reaction zones can be used to sequentially conduct the separate operations within one piece of equipment. Illustrations of suitable extruders are set forth, e.g., in U.S. Pat. No. 3,862,265 and U.S. Pat. No. 5,837,773, which descriptions are incorporated herein by reference.

In forming the acylated olefin copolymers, the olefin copolymer generally is fed into processing equipment such as an extruder, intensive mixer or masticator, heated to a temperature of at least 60° C., for example, 150° to 240° C., and the ethylenically unsaturated acylating agent and free-radical initiator are separately co-fed to the molten copolymer to effect grafting. The reaction is carried out optionally with mixing conditions to effect grafting of the olefin copolymers. If molecular weight reduction and grafting are performed simultaneously, illustrative mixing conditions are described in U.S. Pat. No. 5,075,383, which are incorporated herein by reference. The processing equipment is generally purged with nitrogen to prevent oxidation of the copolymer and to aid in venting unreacted reagents and byproducts of the grafting reaction. The residence time in the processing equipment is controlled to provide for the desired degree of acylation and to allow for purification of the acylated copolymer via venting. Mineral or synthetic lubricating oil may optionally be added to the processing equipment after the venting stage to dissolve the acylated copolymer. Mineral or synthetic lubricating oil also may optionally be added before or during the feeding of ethylenically unsaturated acylating agent or free-radical initiator.

The grafting reaction can be carried out in solvent-free or essentially solvent free environment minimizing the amount of solvent (i.e. less than 1 wt %). The avoidance of hydrocarbon solvents during the grafting reaction, such as alkanes (e.g., hexane) or mineral oils, eliminates or significantly reduces the risk and problem of undesired side reactions of such solvents during the grafting reaction which can form undesired grafted alkyl succinic anhydride by-products and impurities. A reduction is achieved in levels of undesirable grafted solvent (i.e., grafted hexyl succinic anhydride) and transient unfunctionalized (nongrafted) copolymer.

The grafted copolymer intermediate exits from the die face of the extruder either immediately after grafting, or after shearing and vacuum stripping (discussed below in more detail) if performed in different sections of the same extruder or a separate extruder arranged in series or with multiple passes with the extruder in which grafting is conducted.

Selected Properties of Copolymer Intermediate

The resulting copolymer intermediate comprises an acylated olefin copolymer characterized by having carboxylic acid acylating functionality randomly within its structure. The amount of carboxylic acid acylating agent (e.g., maleic anhydride) that is grafted onto the prescribed copolymer backbone (i.e., the copolymer substrate) is important. This parameter is referred to as the mass percentage of acylating agent on the acylated copolymer and generally is in the range of 0.5 to 5.0 wt. %, particularly in the range of 0.6 to 3.0, and more particularly in the range of 1.7 to 2.3 wt. %, of carboxylic acid acylating agent grafted on the copolymer backbone. These numbers are more representative of the amount of carboxylic acid acylating agent being maleic anhydride and may be adjusted to account for agents having higher or lower molecular weights or greater or lesser amounts of acid functionality per molecule.

The carboxylic reactant is grafted onto the prescribed copolymer backbone to provide 0.15 to 0.75 carboxylic groups per 1000 number average molecular weight units (Mn) of the copolymer backbone, preferably 0.2 to 0.5 carboxylic groups per 1000 number average molecular weight. For example, a copolymer substrate with Mn of 20,000 is grafted with 3 to 15 carboxylic groups per copolymer chain or 1.5 to 7.5 moles of maleic anhydride per mole of copolymer. A copolymer with Mn of 100,000 is grafted with 15 to 75 carboxylic groups per copolymer chain or 7.5 to 37.5 moles of maleic anhydride per copolymer chain. The minimum level of functionality is the level needed to achieve the minimum satisfactory soot dispersancy and/or wear performance.

Molecular Weight Reduction of Copolymer Intermediate

The molecular weight of the acylated olefin copolymer, i.e., the copolymer intermediate, may be reduced by mechanical, thermal, or chemical means, or a combination thereof. Techniques for degrading or reducing the molecular weight of such copolymers are generally known in the art. The number average molecular weight is reduced to suitable level for use in lubricating oils. In one embodiment, the initial copolymer intermediate has an initial number average molecular weight ranging from about 5,000 to about 250,000 upon completion of the grafting reaction. In one embodiment, to prepare an additive intended for use in multigrade oils, the copolymer intermediate's number average molecular weight is reduced down to a range of about 5,000 to about 120,000.

Alternatively, grafting and reduction of the high molecular weight olefin copolymer may be done simultaneously. In another alternative, the high molecular weight olefin copolymer may be first reduced to the prescribed molecular weight before grafting. When the olefin copolymer's average molecular weight is reduced before grafting, its number average molecular weight is sufficiently reduced to a value below about 120,000, e.g., in the range of about 5,000 to 80,000.

Reduction of the molecular weight of the copolymer intermediate, or the olefin copolymer feed material during or prior to grafting, to a prescribed lower molecular weight typically is conducted in the absence of a solvent or in the presence of a base oil using either mechanical, thermal, or chemical means, or combination of these means. Generally, the copolymer intermediate, or olefin copolymer, is heated to a molten condition at a temperature in the range of about 180° C. to about 350° C. and it is then subjected to mechanical shear, thermally or chemical induced cleavage or combination of said means, until the copolymer intermediate (or olefin copolymer) is reduced to the prescribed molecular weight. The shearing may be effected within an extruder section, such as described, e.g., in U.S. Pat. No. 5,837,773, which descriptions are incorporated herein by reference. Alternatively, mechanical shearing may be conducted by design of screw elements to increase shear or forcing the molten copolymer intermediate (or olefin copolymer) through fine orifices under pressure or by other mechanical means. Alternatively, the reduction in molecular weight may be achieved in absence of a solvent or presence of base oil by mechanical means in a masticator.

Vacuum Stripping of Unreacted Ingredients

Upon completion of the grafting reaction, unreacted carboxylic reactant and free radical initiator usually are removed and separated from the copolymer intermediate before further functionalization is performed on the copolymer intermediate. The unreacted components may be eliminated from the reaction mass by vacuum stripping, e.g., the reaction mass may be heated to temperature of about 150° C. to about 450° C. under agitation with a vacuum applied for a period sufficient to remove the volatile unreacted graft monomer and free radical initiator ingredients. Vacuum stripping preferably is performed in an extruder section equipped with a vacuum line.

Pelletization of Copolymer Intermediate

The copolymer intermediate may be pelletized before further processing in accordance with embodiments of the disclosure herein. Pelletization of the copolymer intermediate helps to isolate the intermediate product and reduce contamination thereof until further processing is conducted thereon at a desired time.

The copolymer intermediate can generally be formed into pellets by a variety of process methods commonly practiced in the art of plastics processing. These include underwater pelletization, ribbon or strand pelletization or conveyor belt cooling. When the strength of the copolymer is inadequate to form into strands, the preferred method is underwater pelletization. Temperatures during pelletization should not exceed 30° C. Optionally, a surfactant can be added to the cooling water during pelletization to prevent pellet agglomeration.

The mixture of water and quenched copolymer pellets is conveyed to a dryer such as a centrifugal drier for removal of water. Pellets can be collected in a box or plastic bag or tray at any volume for storage and shipment. Under some conditions of storage and/or shipment at ambient conditions, pellets may tend to agglomerate and stick together. These can be readily ground by mechanical methods to provide high surface area solid pieces for easy and quick dissolution into oil.

Dissolution of Pelletized Copolymer Intermediate

The pelletized copolymer intermediate may be supplied as an unground or ground form of the pellets. Typically, the pelletized copolymer intermediate having number average molecular weight greater than 15,000 is diluted in base oil to lower the viscosity for subsequent handling and functionalization. The pellets generally are dissolved in the base oil at an level of from about 3 wt. % to about 49 wt. %, particularly about 5 wt. % to about 30 wt. %, and more particularly about 7 wt. % to about 13 wt. %, based on the resulting solution viscosity. The copolymer intermediate having number average molecular weight less than 15,000 can be used without the base oil dilution or may require low amount of the base oil (e.g., less than 60 wt %, preferably less than 40 wt % base oil) for subsequent functionalization due to the lower viscosity of the copolymer intermediate.

The pelletized copolymer intermediate can be dissolved in the solvent neutral oil at temperature of, for example, about 100° C. to about 165° C. with mechanical stirring under an inert atmosphere. The dissolving mixture is sparged with inert gas during the dissolution for about 2 to 16 hours. This treatment can performed in a continuous stirred process vessel of suitable capacity.

The inert sparging gas can be nitrogen. The dissolution and sparging, if used, can be prior to the subsequent amination procedure. One or more spargers are located within the vessel at locations submerged beneath the surface of the solution, preferably near the bottom of the solution, and bubble inert gas through the solution. Nitrogen sparging removes moisture from the dissolved copolymer intermediate and solvent oil. Importantly, the removal of moisture from the copolymer intermediate acts to convert any polymeric dicarboxylic diacids present back to the desired copolymeric dicarboxylic anhydride form.

For instance, where maleic anhydride is used as the grafting monomer, some portion of the pelletized copolymer intermediate may inadvertently transform to a copolymeric succinic diacid form. In general, this change is more apt to occur as a function of a longer shelf life. The conducting of nitrogen sparging during dissolution of the copolymer intermediate and prior to amination has the benefit of converting the copolymeric succinic diacid back into the desired active polymeric succinic anhydride form before the copolymer intermediate is further reacted and functionalized (e.g., aminated). Consequently, a more highly functionalized and active aminated product can be obtained in subsequent processing. The conversion of polymeric succinic diacid present back into the active polymeric succinic anhydride form can be monitored by measuring the viscosity of the solution. The solution viscosity decreases significantly from an initial higher value down to a steady-state value upon conversion of all or essentially all of the polymeric succinic diacid back into the desired polymeric succinic anhydride form.

The neutral oil may be selected from Group I base stock, Group II base stock, Group III base stock, Group IV or poly-alpha olefins (PAO), Group V or base oil blends thereof. The base stock or base stock blend preferably has a saturate content of at least 65%, more preferably at least 75%; a sulfur content of less than 1%, preferably less than 0.6%, by weight; and a viscosity index of at least 85, preferably at least 100. These base stocks are defined below.

Functionalization of the Acylated Ethylene-Alpha Olefin Copolymer with a Hydrocarbyl Substituted Poly(Oxyalkylene) Monoamine As used herein, the following terms have the following meanings unless expressly stated to the contrary.

The term "amino" refers to the group: —$NH_2$.

The term "N-alkylamino" refers to the group: —$NHR_a$ wherein $R_a$ is an alkyl group.

The term "hydrocarbyl" refers to an organic radical primarily composed of carbon and hydrogen which may be aliphatic, alicyclic, aromatic or combinations thereof, e.g., arylalkyl or alkaryl. Such hydrocarbyl groups are generally free of aliphatic unsaturation, i.e., olefinic or acetylenic unsaturation, but may contain minor amounts of heteroatoms, such as oxygen or nitrogen, or halogens, such as chlorine.

The term "alkyl" refers to both straight- and branched-chain alkyl groups. The term "lower alkyl" refers to alkyl groups having 1 to about 6 carbon atoms and includes primary, secondary, and tertiary alkyl groups. Typical lower alkyl groups include, for example, methyl, ethyl, n-propyl, isopropyl, n-butyl, sec-butyl, t-butyl, n-pentyl, n-hexyl, and the like.

The term "alkylene" refers to straight- and branched-chain alkylene groups having at least 2 carbon atoms. Typical alkylene groups include, for example, ethylene (—$CH_2CH_2$—), propylene (—$CH_2CH_2CH_2$—), isopropylene (—$CH(CH_3)CH_2$—), n-butylene (—$CH_2CH_2CH_2CH_2$—), sec-butylene (—$CH(CH_2CH_3)CH_2$—), and the like.

The term "aryl" refers to fully unsaturated mono and di-fused ring carbocyclic groups including substituted and unsubstituted phenyl and substituted and unsubstituted naphthyl.

The term "alkylaryl" refers to an alkyl substituted aryl radical.

The term "arylalkyl" refers to an aryl substituted alkyl radical such as benzyl group.

The term "poly(oxyalkylene)" refers to a polymer or oligomer having the general formula:

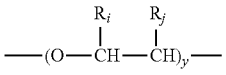

wherein $R_i$ and $R_j$ are each independently hydrogen or lower alkyl groups, and y is an integer from about 2 to about 45, preferably from about 5 to 35, more preferably from about 10 to 25. When referring herein to the number of oxyalkylene units in a particular polyoxyalkylene compound, it is to be understood that this number refers to the average number of oxyalkylene units in such compounds unless expressly stated to the contrary. Although the number of oxyalkylene units, y, in a single polymer molecule is an integer (e.g., 12), the average number of such units in a polyoxyalkene compound having a mixture of polymer molecules of various molecular weights can be a non-integer (e.g., 12.5).

General Synthetic Procedures

The preferred hydrocarbyl-substituted poly(oxyalkylene) monoamines employed in this invention may be prepared by the following general methods and procedures. It should be appreciated that where typical or preferred process conditions (e.g., reaction temperatures, times, mole ratios of reactants, solvents, pressures, etc.) are given, other process conditions may also be used unless otherwise stated. Optimum reaction conditions may vary with the particular reactants or solvents used, but such conditions can be determined by one skilled in the art by routine optimization procedures.

The preferred hydrocarbyl-substituted poly(oxyalkylene) monoamines employed in the present invention contain (a) a hydrocarbyl-substituted poly(oxyalkylene) component, and (b) an amine component.

A. The Hydrocarbyl-Substituted Poly(Oxyalkylene) Component

The hydrocarbyl-substituted poly(oxyalkylene) polymers which are utilized in preparing the hydrocarbyl-substituted poly(oxyalkylene) monoamines employed in the present invention are monohydroxy compounds, i.e., alcohols, often termed hydrocarbyl "capped" poly(oxyalkylene) glycols and are to be distinguished from the poly(oxyalkylene) glycols (diols), which are not hydrocarbyl terminated, i.e., not capped. The hydrocarbyl-substituted poly(oxyalkylene) alcohols are produced by the addition of lower alkylene oxides, such as ethylene oxide, propylene oxide, or butylene oxides, to the hydroxy compound, $R_{1a}OH$, under polymerization conditions, wherein $R_{1a}$ is the hydrocarbyl group, as defined above, which caps the polyoxyalkylene chain. Preferred poly(oxyalkylene) polymers are those derived from $C_2$ to $C_3$ oxyalkylene units. Methods of production and properties of these polymers are disclosed in U.S. Pat. Nos. 2,841,479 and 2,782,240. In the polymerization reaction, a single type of alkylene oxide may be employed, e.g., ethylene oxide, in which case the product is a homopolymer, e.g., a poly(oxyethylene) alcohol. However, copolymers are equally satisfactory and random copolymers are readily prepared by contacting the hydroxy-containing compound with a mixture of alkylene oxides, such as a mixture of ethylene and propylene oxides. Block copolymers of oxyalkylene units also provide satisfactory poly(oxyalkylene) units for the practice of the present invention. The amount of alkylene oxide employed in this reaction will generally depend on the number of oxyalkylene units desired in the product. Typically, the molar ratio of alkylene oxide to hydroxy-containing compound will range from about 2:1 to about 45:1; preferably, from about 5:1 to about 35:1, more preferably from about 10:1 to about 25:1.

Alkylene oxides suitable for use in this polymerization reaction include, for example, ethylene oxide; propylene oxide; and butylene oxides, such as 1,2-butylene oxide (1,2-epoxybutane) and 2,3-butylene oxide (2,3-epoxybutane). Preferred alkylene oxides are ethylene oxides, propylene oxide and 1,2-butylene oxide, both individually and in mixtures thereof. Particularly suited are mixtures of ethylene oxide and propylene oxide, having a greater proportion of ethylene oxide.

The hydrocarbyl moiety, $R_{1a}$, which terminates the poly (oxyalkylene) chain will generally contain from about 1 to about 35 carbon atoms and is generally derived from the monohydroxy compound, $R_{1a}OH$, which is the initial site of the alkylene oxide addition in the polymerization reaction. Such monohydroxy compounds are preferably aliphatic or aromatic alcohols (optionally substituted) having from about 1 to about 35 carbon atoms including substituted moieties with alkyl, aryl, arylalkyl, alkaryl substituents. Such as alkanol from 1 to about 18 carbon atoms, more preferably 1 to about 10 carbon atoms such as lower alkyl derived alkanols including for example, methanol, ethanol, propanol, butanol, isopropanol, sec-butanol and the like, an alkylphenol, and most preferably an alkylphenol wherein the alkyl substituent is a straight or branched chain alkyl of from about 1 to about 24 carbon atoms, an aryl substituted phenol such as mono- di- and tri-phenyl-phenol, alkaryl phenol, and aryalkyphenol such as tri-strylphenol, naphthol, and alkyl substituted naphthols. Preferred alkylphenols include those wherein the alkyl substituent contains from about 4 to about 16 carbon atoms. An especially preferred alkylphenol is one wherein the alkyl is an n-dodecyl group.

B. The Amine Component

As indicated above, the preferred hydrocarbyl-substituted poly(oxyalkylene) monoamines employed in the present invention contain an amine component. The amine component of the preferred hydrocarbyl-substituted poly(oxyalkylene) amines employed in this invention is preferably derived from ammonia, a —$CH_2$amino derived from cyanoalkylation, or a primary alkyl monoamine.

Primary alkyl monoamines useful in preparing compounds employed in the present invention contain 1 nitrogen atom and from about 1 to about 10 carbon atoms, more preferably about 1 to 6 carbon atoms, most preferably 1 to 4 carbon atoms. Examples of suitable monoamines include N-methylamine, N-ethylamine, N-n-propylamine, N-isopropylamine, N-n-butylamine, N-isobutylamine, N-sec-butylamine, N-tert-butylamine, N-n-pentylamine, N-cyclopentylamine, N-n-hexylamine, N-cyclohexylamine, N-octylamine, N-decylamine, Preferred primary alkyl amines are N-methylamine, N-ethylamine and N-n-propylamine.

C. Preparation of the Hydrocarbyl-Substituted Poly(Oxyalkylene) Monoamine

The preferred hydrocarbyl-substituted poly(oxyalkylene) amine additives employed in this invention may be conveniently prepared by reacting a hydrocarbyl-substituted poly (oxyalkylene) alcohol, either directly or through an intermediate, with a nitrogen-containing compound, such as ammonia or a primary alkyl monoamine, as described herein.

The hydrocarbyl-substituted poly(oxyalkylene) alcohols used to form the poly(oxyalkylene) amines employed in the present invention are typically known compounds that can be prepared using conventional procedures. Suitable procedures for preparing such compounds are taught, for example, in U.S. Pat. Nos. 2,782,240 and 2,841,479, as well as U.S. Pat. No. 4,881,945, the disclosures of which are incorporated herein by reference. Preferably, the poly(oxyalkylene) alcohols are prepared by contacting an alkoxide or phenoxide metal salt with from about 2 to about 45 molar equivalents of an alkylene oxide, such as ethylene oxide, propylene oxide or butylene oxide, or mixtures of alkylene oxides.

Typically, the alkoxide or phenoxide metal salt is prepared by contacting the corresponding hydroxy compound with a strong base, such as sodium hydride, potassium hydride, sodium amide, and the like, in an inert solvent, such as toluene, xylene, and the like, under substantially anhydrous conditions at a temperature in the range from about −10° C. to about 120° C. for from about 0.25 to about 3 hours. The alkoxide or phenoxide metal salt is generally not isolated, but is reacted in situ with the alkylene oxide or mixture of alkylene oxides to provide, after neutralization, the poly (oxyalkylene) alcohol. This polymerization reaction is typically conducted in a substantially anhydrous inert solvent at a temperature of from about 30° C. to about 150° C. for from about 2 to about 120 hours. Suitable solvents for this reaction, include toluene, xylene, and the like. Typically, the reaction is conducted at a pressure sufficient to contain the reactants and the solvent, preferably at atmospheric or ambient pressure.

The hydrocarbyl-substituted poly(oxyalkylene) alcohol may then be converted to the desired poly(oxyalkylene) monoamine by a variety of procedures known in the art. For example, the terminal hydroxy group on the hydrocarbyl-substituted poly(oxyalkylene) alcohol may first be converted to a suitable leaving group, such as a mesylate, chloride or bromide, and the like, by reaction with a suitable reagent, such as methanesulfonyl chloride. The resulting poly(oxyalkylene) mesylate or equivalent intermediate may then be converted to a phthalimide derivative by reaction with potassium phthalimide in the presence of a suitable solvent, such as N,N-dimethylformamide. The poly(oxyalkylene) phthalimide derivative is subsequently converted to the desired hydrocarbyl-substituted poly(oxyalkylene) amine by reaction with a suitable amine, such as hydrazine.

The poly(oxyalkylene) alcohol may also be converted to the corresponding poly(oxyalkylene) chloride by reaction with a suitable halogenating agent, such as HCl, thionyl chloride, or epichlorohydrin, followed by displacement of the chloride with a suitable amine, such as ammonia, a primary alkyl monoamine, as described, for example, in U.S. Pat. No. 4,247,301 to Honnen.

Alternatively, the preferred hydrocarbyl-substituted poly (oxyalkylene) monoamines employed in the present invention may be prepared from the corresponding poly(oxyalkylene) alcohol by a process commonly referred to as reductive amination, such as described in U.S. Pat. No. 5,112,364 to Rath et al. and U.S. Pat. No. 4,332,595 to Herbstman et al. In the reductive amination procedure, the hydrocarbyl-substituted poly(oxyalkylene) alcohol is aminated with an appropriate amine, such as ammonia or a primary alkyl monoamine, in the presence of hydrogen and a hydrogenation-dehydrogenation catalyst. The amination reaction is typically carried out at temperatures in the range of about 160° C. to about 250° C. and pressures of about 1,000 to about 5,000 psig, preferably about 1,500 to about 3,000 psig. Suitable hydrogenation-dehydrogenation catalysts include those containing platinum, palladium, cobalt, nickel, copper, or chromium, or mixtures thereof. Generally, an excess of the ammonia or amine reactant is used, such as about a 5-fold to about 60-fold molar excess, and preferably about a 10-fold to about 40-fold molar excess, of ammonia or amine.

In another aspect, the hydrocarbyl-substituted poly(oxyalkylene) monoamine amine is prepared by cyanoalkylation of a hydrocarbyl-substituted poly(oxyalkylene) alcohol moiety followed by hydrogenation and such reactions are known in the art, U.S. Pat. Nos. 2,974,160; 2,421,837; U.S. Pat. App. 2003/0150154 and the like. Commonly, a hydrocarbyl-substituted poly(oxyalkylene) alcohol is reacted with acrylonitrile in the presence a well-known catalyst at a temperature in the range of about 20° C. to 100° C., and preferably from about 25° C. to 65° C. Typical catalysts include alkali metal hydroxides, alkoxides and hydrides, alkali metal salts, and tetrahydrocarbyl ammonium hydroxides and alkoxides. The amount of base employed will generally range from about 0.001 to 1.0 equivalent, preferably from about 0.01 to 0.1 equivalent. The acrylonitrile employed will generally range from about 1 to 20 equivalents, preferably from about 1 to 10 equivalents. The reaction may take place in the presence or absence of an inert solvent. The time of reaction will vary depending on the particular hydrocarbyl-substituted poly(oxyalkylene) alcohol and acrylonitrile reactants, the catalyst used and the reaction temperature. Particularly suited acrylonitrile reactants include the group selected from acrylonitrile, 2-methyl-acrylnitrile, 2-methyl-but-2-enenitrile, 2-ethyl-but-2-enenitrile, 2-methylene-butyronitrile, but-2-enenitrile and pent-2-enenitrile. Particularly preferred are acrylonitrile and 2-methyl-acrylnitrile.

The CN group from the cyanoalkylation reaction may be reduced by any number of procedures well known in the art to an —$CH_2$amino group —$CH_2NH_2$ group under catalytic hydrogenation conditions. Typically, this reaction is conducted using a nickel, Raney nickel, cobalt, Raney cobalt, copper-chromite, platinum, palladium, or rhodium catalyst. Preferably, the catalyst is nickel, Raney nickel, or platinum. The hydrogen pressure, time, and temperature depend on the catalyst employed. An inert solvent may be employed such as ethanol, ethyl acetate, and the like. Hydrogenation of CN groups is further discussed, for example, in P. N. Rylander, Catalytic Hydrogenation in Organic Synthesis, Second Edition, pp. 138-152, Academic Press (1979) and H. F. Rase, Handbook of Commercial Catalysts, Heterogeneous Catalyst, pp. 138-148, CRC Press (2000) and references cited therein. The hydrocarbyl-substituted poly(oxyalkylene) monoamines used in this invention are monoamines having a molecular weight of from about 150 to about 5,000, such polyether materials having 2 to 45 alkylene oxide units preferably independently selected from ethylene oxide, propylene oxide or butylene oxide. Thus in one aspect the hydrocarbyl substituted poly(oxyalkylene) monoamine of the formula:

$$R_1—(O—CHR_2—CHR_3)_x\text{-}A$$

wherein: $R_1$ is a hydrocarbyl group having from about 1 to about 35 carbon atoms; $R_2$ and $R_3$ are each independently hydrogen, methyl, or ethyl and each $R_2$ and $R_3$ are independently selected in each —O—$CHR_2$—$CHR_3$— unit; A is amino, —$CH_2$amino or N-alkyl amino having about 1 to 10 carbon atoms; and x is an integer from about 2 to about 45, preferably from 5 to 30, more preferably from 10 to 25.

In one regard, when A is —$CH_2$amino, the hydrocarbyl substituted poly(oxyalkylene) monoamine may be represented by the formula $R_1—(O—CHR_2—CHR_3)_x—CH_2NH_2$, wherein: $R_1$ is a hydrocarbyl group having from about 1 to about 35 carbon atoms; $R_2$ and $R_3$ are each independently hydrogen, methyl, or ethyl and each $R_2$ and $R_3$ are independently selected in each —O—$CHR_2$—$CHR_3$— unit.

Preferred hydrocarbyl-substituted poly(oxyalkylene) monoamines have a molecular weight of from about 400 to about 3,000 containing ethylene oxide and propylene oxide groups or mixed ethylene oxide and propylene oxide.

One preferred ethylene oxide propylene oxide hydrocarbyl-substituted poly(oxyalkylene) monoamine can be represented by the formula:

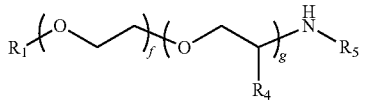

wherein: $R_1$ is defined herein above, $R_4$ is independently hydrogen or methyl for each repeat unit g, $R_5$ is hydrogen or alkyl from 1 to 10 carbon atoms; f and g are integers such that f+g is from 2 to 45. In one aspect, the moles of ethylene oxide "EO" is equal to or greater than propylene oxide "PO".

In one embodiment of the present invention, the polyether monoamines are prepared form ethylene oxide, propylene oxide or combinations thereof. When both ethylene oxide and propylene oxide are used, the oxides can be reacted simultaneously when a random polyether is desired, or reacted sequentially when a block polyether is desired. Generally, when the hydrocarbyl-substituted poly(oxyalkylene) monoamine is prepared from ethylene oxide, propylene oxide or combinations thereof, the amount of ethylene oxide on a molar basis is greater than about 50 percent of the hydrocarbyl-substituted poly(oxyalkylene) monoamine, preferably greater than about 75 percent and more preferably greater than about 85 percent. The hydrocarbyl-substituted poly(oxyalkylene) monoamines used in the practice of this invention can be prepared using well known amination techniques such as described in U.S. Pat. No. 3,654,370; U.S. Pat. No. 4,152,353; U.S. Pat. No. 4,618,717; U.S. Pat. No. 4,766,245; U.S. Pat. No. 4,960,942; U.S. Pat. No. 4,973,761; U.S. Pat. No. 5,003,107; U.S. Pat. No. 5,352,835; U.S. Pat. No. 5,422,042; and U.S. Pat. No. 5,457,147. Generally, the hydrocarbyl-substituted poly(oxyalkylene) monoamines are made by aminating a poly(oxyalkylene) alcohol with ammonia in the presence of a catalyst such as a nickel containing catalyst such as a Ni/Cu/Cr catalyst.

In one aspect, when $R_1$ is methyl and $R_5$ is hydrogen, particularly suited compounds include JEFFAMINE® M-600 (approx MW 600 EO/PO-1/9), JEFFAMINE® M-1000 (approx MW 1000 EO/PO-19/3), JEFFAMINE® M-2070 (approx MW 2000 EO/PO-31/10), and JEFFAMINE® M-2005 (approx MW 2000 EO/PO-6/29). Preferred polyether monoamines include JEFFAMINE® M-1000 and JEFFAMINE® M-2070. The above JEFFAMINE® compounds are available from Huntsman Chemicals. More preferred polyether monoamines of the present invention have a molecular weight in the range from about 400 to about 2500. One especially preferred hydrocarbyl-substituted poly(oxyalkylene) monoamine which contains from about 2 to about 35 ethylene oxide units and from 1 to about 10 propylene oxide units.

In one aspect, the monoamine-terminated polyethers have a molecular weight of from about 1,000 to about 3,000. While described above, these particular JEFFAMINE® materials are methoxy terminated, the polyether monoamines used in practice of this invention can be capped with any other groups in which the methyl group of the methoxy group is replaced with a higher hydrocarbon such as ethyl, propyl, butyl, etc., including any alkyl substituent which comprises up to about 18 carbons. It is especially preferred that the amine termination is a primary amine group.

Certain methanol initiated polyether monoamines are of formula:

$$CH_3O(CH_2CH_2O)_m—(CH_2\underset{\underset{CH_3}{|}}{C}HO)_n—CH_2\underset{\underset{CH_3}{|}}{C}HNH_2$$

wherein m is about 1 to about 35 and wherein n is about 1 to about 15, in one aspect m>n, including polyether monoamines wherein m is about 15 to about 25 and n is about 2 to about 10.

The mixing of the acylated polyolefin and hydrocarbyl-substituted poly(oxyalkylene) monoamine and optionally also polyolefin may be carried out in a customary mixing apparatus including batch mixers, continuous mixers, kneaders, and extruders. For most applications, the mixing apparatus will be an extruder with grafting and post-grafting derivation accomplished in a two-stage or one-stage process performed in the melt or in solution in a solvent such as a mineral or lubricating oil. In solution, it is convenient to heat the solution of copolymer intermediate having grafted thereon carboxylic acid acylating group and the prescribed polyether monoamine or mixture or polyether monoamines under inert conditions while mixing under reactive conditions. Typically the solution is heated to about 125° C. to about 175° C. under a nitrogen blanket. The amount of polyether monoamine will typically be on an order of 0.25 to about 2.0 equivalent amine to carboxylic acid (anhydride) functionality. In one aspect the amount of polyether monoamine will typically be on an order of 0.25 to about 1.50 equivalent amine to carboxylic acid (anhydride) functionality; in yet another aspect The amount of polyether monoamine will typically be on an order of 0.8 to about 2.0 equivalent amine to carboxylic acid (anhydride) functionality.

Concentrate

Another aspect is directed to a Viscosity Index ("VI") improver composition in the concentrate form. In a particular embodiment the acylated ethylene-alpha olefin copolymer reacted with the hydrocarbyl poly(oxyalkylene) monoamine (derivative-OCP) is used as a Viscosity Index ("VI") improver for a lubricating oil composition. Preferably the derivatized-OCP has solubility in base oil of at least 10 wt %. From 0.001 to 49 wt % of this composition is incorporated into a base oil, or a lubricating oil, depending upon whether the desired product is a finished product or an additive concentrate. The amount of the VI improver used is an amount which is effective to improve or modify the Viscosity Index of the base oil, i.e., a viscosity improving effective amount. Generally, this amount is from 0.001 to 20 wt % for a finished product (e.g., a fully formulated lubricating oil composition), with alternative lower limits of 0.01%, 0.1% or 1%, and alternative upper limits of 15% or 10%, in other embodiments. Ranges of VI Improver concentration from any of the recited lower limits to any of the recited upper limits are within the scope of the present invention, and one skilled in the art can readily determine the appropriate concentration range based upon the ultimate solution properties. Base oils suitable for use in preparing the lubricating compositions of the present invention include those conventionally employed as crankcase lubricating oils for spark-ignited and compression-ignited internal combustion engines, such as automobile and truck engines, marine and railroad diesel engines, and the like produced from natural feedstock. The lubricating oils to which the products of this invention can be added include not only hydrocarbon oils derived from petroleum, but also include synthetic lubricating oils such as esters of dibasic acids; complex esters made by esterification of monobasic acids, polyglycols, dibasic acids and alcohols; polyolefin oils, etc. Thus, the VI Improver compositions of the present invention may be suitably incorporated into synthetic base oils such as alkyl esters of dicarboxylic acids, polyglycols and alcohols; poly-alpha olefins; polybutenes; alkyl benzenes; organic esters of phosphoric acids; polysilicone oils; etc.

The VI compositions of the present invention can also be utilized in a concentrate form, such as from 1 wt % to 49 wt. % in oil, e.g., mineral lubricating oil, for ease of handling, and may be prepared in this form by carrying out the reaction of the invention in oil as previously described. The above oil compositions may optionally contain other conventional additives, such as, for example, pour point depressants, antiwear agents, antioxidants, other Viscosity Index Improvers, dispersants, corrosion inhibitors, anti-foaming agents, detergents, rust inhibitors, friction modifiers, and the like.

An acylated olefin copolymer intermediate can be reacted with poly(oxyalkylene) monoamine in presence of suitable surfactants. Surfactants which may be used in carrying out the reaction of the acylated olefin copolymer with the poly(oxyalkylene) monoamine include but are not limited to those characterized as having solubility characteristics compatible with mineral or synthetic lubricating oil, and/or polarity suitable for solubilizing the poly(oxyalkylene) monoamine Commonly used surfactants are aliphatic or phenolic alkoxylates. Representative examples are SURFONIC® L-24-2, NB40, N-60, L-24-5, L-46-7 (Huntsman Chemical Company), NEODOL® 23-5 and 25-7 (Shell Chemical company) and TERGITOL® surfactants (Union Carbide). The surfactant also modifies the viscoelastic response of the acylated olefin copolymer reacted with poly(oxyalkene) monoamine. The surfactants can also be added separately, instead of or in addition to the concentrates discussed above, such that the total amount of surfactant in the finished additive is 10 wt % or less.

Polymer Analyses

The weight % of carboxylic acylating agent incorporated into the backbone can be determined either by infrared peak ratio analysis of acid or anhydride moiety versus copolymer alkyl functionality or by titration (Total Acid/Anhydride Number) (TAN) of the additive reaction product. The TAN value in turn can be used to estimate the degree of grafting of the carboxylic agent.

The ethylene contents as an ethylene weight percent ($C_2$ wt %) for the ethylene-alpha olefin copolymers can be determined according to ASTM D3900. The number average molecular weight is measured by GPC using trichlorobenzene at 145° C. as solvent and triple-detection method using polystyrene standards.

Thickening efficiency (TE) is a measure of the thickening ability of the polymer in oil at 100° C., and is defined as: $TE=2/c\times\ln((kv_{(polymer+oil)})/kv_{oil})//\ln(2)$, where c is the concentration of the polymer and kv is kinematic viscosity at 100° C. according to ASTM D445. The shear stability index (SSI) is an indication of the resistance of polymers to permanent mechanical shear degradation in an engine. The SSI can be determined by passing a polymer-oil solution for 30 cycles through a high shear Bosch diesel injector according to the procedures listed in ASTM D6278. The SSI of a polymer can be calculated from the viscosity of the oil without polymer and the initial and sheared viscosities of the polymer-oil solution using:

$$SSI=100\times(kv_{(polymer+oil),fresh}-kv_{(polymer+oil),sheared})/(kv_{(polymer+oil),fresh}-kv_{oil,fresh})$$

The Lubricating Oil Composition

The polymeric composition or the oil-soluble product produced by the process of the present invention are typically added to base oil in sufficient amounts to provide soot and/or sludge dispersancy and/or wear control and/or viscosity index improvement when used in lubricating oil compositions for internal combustion engines. Generally, the lubricating oil compositions of the present invention will contain a major amount of base oil of lubricating viscosity and a minor amount of the polymeric composition or the oil-soluble concentrate product produced by the process of the present invention.

Base Oil of Lubricating Viscosity

Base oil as used herein is defined as a base stock or blend of base stocks which is a lubricant component that is produced by each manufacturer to the same specifications (independent of feed source or manufacturer's location); that meets the same manufacturer's specification; and that is identified by a unique formula, product identification number, or both. Base stocks may be manufactured using a variety of different processes including but not limited to distillation, solvent refining, hydrogen processing, oligomerization, esterification, and rerefining. Rerefined stock shall be substantially free from materials introduced through manufacturing, contamination, or previous use. The base oil of this invention may be any natural or synthetic lubricating base oil fraction particularly those having a kinematic viscosity at 100° C. of about 3 centistokes (cSt) to about 20 cSt. Hydrocarbon synthetic oils may include, for example, oils prepared from the polymerization of ethylene, poly alpha olefin or PAO, or from hydrocarbon synthesis procedures using carbon monoxide and hydrogen gases such as in a Fisher-Tropsch process. A preferred base oil is one that comprises little, if any, heavy fraction; e.g., little, if any, lube oil fraction of viscosity about 20 cSt or higher at about 100° C. Oils used as the base oil will be selected or blended depending on the desired end use and the additives in the finished oil to give the desired grade of engine oil, e.g. a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, or 15W-40.

The base oil may be derived from natural lubricating oils, synthetic lubricating oils or mixtures thereof. Suitable base oil includes base stocks obtained by isomerization of synthetic wax and slack wax, as well as hydrocrackate base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Saturates levels and viscosity indices for Group I, II and III base oils are listed in Table O. Group IV base oils are polyalphaolefins (PAO). Group V base oils include all other base oils not included in Group I, II, III, or IV. Group III base oils are preferred.

TABLE O

Saturates, Sulfur and Viscosity Index of Group I, II, III, IV and V Base Stocks

| Group | Saturates (As determined by ASTM D2007) Sulfur (As determined by ASTM D2270) | Viscosity Index (As determined by ASTM D4294, ASTM D4297 or ASTM D3120) |
|---|---|---|
| I | Less than 90% saturates and/or Greater than to 0.03% sulfur | Greater than or equal to 80 and less than 120 |
| II | Greater than or equal to 90% saturates and less than or equal to 0.03% sulfur | Greater than or equal to 80 and less than 120 |
| III | Greater than or equal to 90% saturates and less than or equal to 0.03% sulfur | Greater than or equal to 120 |

TABLE O-continued

Saturates, Sulfur and Viscosity Index of Group I, II, III, IV and V Base Stocks

| Group | Saturates (As determined by ASTM D2007) Sulfur (As determined by ASTM D2270) | Viscosity Index (As determined by ASTM D4294, ASTM D4297 or ASTM D3120) |
|---|---|---|
| IV | All Polyalphaolefins (PAOs) | |
| V | All others not included in Groups I, II, III, or IV | |

Synthetic oils may include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogues and homologues thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from about C5 to about C12 monocarboxylic acids and polyols and polyol ethers. Tri-alkyl phosphate ester oils such as those exemplified by tri-n-butyl phosphate and tri-iso-butyl phosphate are also suitable for use as base oils.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The base oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which may then be used without further treatment. Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

It is preferred to use a major amount of base oil in the lubricating oil composition of the present invention. A major amount of base oil as defined herein comprises 50 wt % or more. Preferred amounts of base oil comprise about 50 wt % to about 97 wt %, more preferably about 60 wt % to about 97 wt % and most preferably about 80 wt % to about 95 wt % of the lubricating oil composition. (When weight percent is used herein, it is referring to weight percent of the lubricating oil unless otherwise specified.)

The amount of oil-soluble product produced by the process of grafting an ethylene-alpha olefin copolymer of the present invention in the lubricating oil composition will be in a minor amount compared to the base oil of lubricating viscosity. Generally, it will be added from the concentrate described herein above, in an amount from about 2 wt % to about 30 wt %, preferably from about 4 wt % to about 20 wt % and more preferably from about 6 wt % to about 12 wt %, based on the total weight of the lubricating oil composition.

Other Additive Components

The following additive components are examples of components that can be favorably employed in combination with the lubricating additive of the present invention. These examples of additives are provided to illustrate the present invention, but they are not intended to limit it.

(A) Dispersants are additives that keep soot and combustion products in suspension in the body of the oil charge and therefore prevent deposition as sludge or lacquer. Typically, the ashless dispersants are nitrogen-containing dispersants formed by reacting alkenyl succinic acid anhydride with an amine. Examples are alkenyl succinimides, alkenyl succinimides modified with other organic compounds, e.g., ethylene carbonating post-treatment and alkenyl succinimides modified with boric acid, polysuccinimides, alkenyl succinic ester.

(B) Oxidation inhibitors: 1) Phenol type phenolic) oxidation inhibitors: 4,4'-methylenebis (2,6-di-tert-butylphenol), 4,4'-bis(2,6-di-tert-butylphenol), 4,4'-bis(2-methyl-6-tert-butylphenol), 2,2'-(methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl4-methylphenol, 2,6-di-tert-butyl4-ethylphenol, 2,4-dimethyl-6-tert-butyl-phenol, 2,6-di-tert-α-dimethylamino-p-cresol, 2,6-di-tert-4(N,N' dimethylaminomethylphenol),4,4'-thiobis(2-methyl-6-tert-butylphenol), 2,2'-thiobis(4-methyl-6-tert-butylphenol), bis (3-methyl-4-hydroxy-5-tert-butylbenzyl)-sulfide, and bis (3,5-di-tert-butyl4-hydroxybenzyl).

2) Diphenylamine type oxidation inhibitor: alkylated diphenylamine, phenyl-α-naphthylamine, and alkylated α-naphthylamine.

3) Other types: metal dithiocarbamate (e.g., zinc dithiocarbamate), and methylenebis (dibutyidithiocarbamate).

(C) Rust inhibitors (Anti-rust agents): 1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate. 2) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(D) Demulsifiers: addition product of alkylphenol and ethyleneoxide, polyoxyethylene alkyl ether, and polyoxyethylene sorbitane ester.

(E) Extreme pressure agents (EP agents): sulfurized oils, diphenyl sulfide, methyl trichlorostearate, chlorinated naphthalene, benzyl iodide, fluoroalkylpolysiloxane, and lead naphthenate.

(F) Friction modifiers: fatty alcohol, fatty acid, amine, borated ester, and other esters.

(G) Multifunctional additives: sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

(H) Viscosity Index improvers: polymethacrylate type polymers, ethylene-alpha olefin copolymers, styrene-isoprene copolymers, hydrogenated styrene-isoprene copolymers, hydrogenated star-branched polyisoprene, polyisobutylene, hydrogenated star-branched styrene-isoprene copolymer, and dispersant type viscosity index improvers.

(I) Pour point depressants: polymethyl methacrylates, alkylmethacrylates, and dialkyl fumarate-vinyl acetate copolymers.

(J) Foam Inhibitors: alkyl methacrylate polymers and dimethyl silicone polymers.

(K) Wear Inhibitors: zinc dialkyldithiophosphate (Zn-DTP, primary alkyl type & secondary alkyl type).

(L) Detergents are additives designed to hold the acid-neutralizing compounds in solution in the oil. They are usually alkaline and react with the strong acids (sulfuric and nitric) which form during the combustion of the fuel and which would cause corrosion to the engine parts if left unchecked. Examples are carboxylates, sulfurized or unsulfurized alkyl or alkenyl phenates, alkyl or alkenyl aromatic sulfonates, sulfurized or unsulfurized metal salts of multihydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof. Aspects can be further understood by reference to the following non-limiting examples.

EXAMPLES

Examples 1-6

Preparation of Acylated Ethylene-Alpha Olefin Copolymer (OCP)

The acylated ethylene-alpha olefin copolymers (OCP) were prepared by free radically grafting maleic anhydride using peroxide in a counter-rotating twin screw extruder on to various ethylene-propylene backbones as listed in Table 1.

Examples 1 and 5 were prepared in a twin-screw extruder by grafting maleic anhydride with peroxide in absence of solvent. The reaction conditions and molar proportions of maleic anhydride, peroxide initiator, and ethylene-propylene copolymer were controlled to obtain desired maleic anhydride grafting level and the number average molecular weight as mentioned in Table 1. The unreacted maleic anhydride and peroxide decomposition products were removed with vacuum stripping prior to pelletizing the acylated polymers.

Acylated ethylene-alpha olefin copolymers of Example 2 and 3 were received from a commercial supplier.

Acylated ethylene-alpha olefin copolymers in Example 4a-4f were prepared in a laboratory extruder under the following conditions: granulated ethylene-alpha olefin copolymer, maleic anhydride, peroxide and poly-alpha olefin (PAO) having kinematic viscosity at 100° C. of 4cSt were pre-mixed in container to obtain a uniform coating of the oil and reagents on the pellets. The amount of the PAO was around 1 wt % of the mixture. Peroxide used was either di-cumyl peroxide or di-tertiary butyl peroxide. The mixture was then fed to co-rotating twin-screw extruder operating at screw speed of 150 rpm and following temperature profile along the extruder: 100° C., 140° C., 225° C., 225° C. with the die at 225° C. The grafting level was varied by changing maleic anhydride content in the feed mixture and/or peroxide. Excess reagents were removed with vacuum stripping prior to die and the extruded polymer was recovered. The maleic anhydride content of all the samples was determined by FTIR or by titration with tetra-butyl ammonium hydroxide. The maleic anhydride content of all the samples in Table 1 was varied from about 0.7 wt % to 2.9 wt %.

Example 6 was prepared in a pilot scale twin-screw extruder by grafting PARATONE® 8921 with maleic anhydride in presence of a peroxide and about 1.5 wt % of a solvent Chevron RLOP 100N during the reaction. The reaction conditions and molar proportions of maleic anhydride, peroxide initiator, and ethylene-propylene copolymer were controlled to obtain desired maleic anhydride grafting level, SSI, and the number average molecular weight as shown in Table 1. The unreacted maleic anhydride and peroxide decomposition products were removed with vacuum stripping prior to pelletizing the acylated polymers.

TABLE 1

Description of the Acylated Olefin Copolymers Used in the Examples

| Example (acylated copolymer backbone) | Ethylene-alpha olefin copolymer (OCP) type | Ethylene Content, wt % | $M_n$ of acylated copolymer, kDa | Maleic Anhydride content, wt % | Thickening Efficiency (acylated copolymer) | Shear Stability Index, % (acylated copolymer) | Concentrate (copolymer/oil) (wt/wt) |
|---|---|---|---|---|---|---|---|
| Comparative | — | — | — | 0 | — | — | — |
| 1 | OCP-1 | 11 | 49730 | 1.5 | 1.08 | 8 | 10/90 |
| 2 | OCP-2 | 49 | 6000 | 1 | — | — | 100/0 |
| 3 | OCP-3 | 49 | 12000 | 1.2 | — | — | 30/70 |
| 4a | OCP-4 | 49 | — | 2.63 | 2.12 | 35 | 7/93 |
| 4b | OCP-4 | 49 | — | 2.13 | 2.09 | 35 | 7/93 |
| 4c | OCP-4 | 49 | 42900 | 1.33 | 1.77 | 30 | 7/93 |
| 4d | OCP-4 | 49 | 39250 | 2.88 | 1.83 | 30 | 7/93 |
| 4e | OCP-4 | 49 | 42900 | 1.94 | 2.05 | 41 | 7/93 |
| 4f | OCP-4 | 49 | 18445 | 1.66 | 1.6 | 25 | 7/93 |
| 5 | OCP-5 | 52 | 88020 | 0.7 | 2.45 | 39 | 7/93 |
| 6 | OCP-6 | 49 | — | 2.51 | 1.7 | 24 | 10/90 |

TABLE 2

Description of the Poly(Oxyalkylene) Monoamines Used in the Examples

| Functionality | End-group | Average moles propylene oxide(PO)/ethylene oxide(EO) | Average Polyether Repeat Units |
|---|---|---|---|
| A | methyl | 9/1 | 10 |
| B | methyl | 2.5/7.2 | 9.7 |
| C | methyl | 3/19 | 22 |
| D | methyl | 29/6 | 35 |
| E | methyl | 10/31 | 41 |
| F | nonyl phenyl | 13.5/0 | 13.5 |
| G | tri-styryl phenyl | 0/16 | 16 |
| H | n-dodecyl phenyl | 3/19 | 22 |
| I | tri-styryl phenyl | 3/19 | 22 |
| J | methyl | 5.4/17.6 | 23 |

Examples 7-26

Preparation of Polyether Mono Amine Functionalized Ethylene-Alpha Olefin Copolymers and their Performance The maleated copolymer was dissolved in a base oil depending on the polymer backbone as shown in Table 1. The maleated copolymer/oil mixture (concentrate) was charged to a stirred glass reactor and heated to about 160° C. The maleated copolymer was reacted with various poly (oxyalkylene) monamines (1.0 mole compound per mole of grafted maleic anhydride) at about 160° C. for two hours and then the reaction mixture was vacuum stripped for additional 30 minutes. The poly(oxyalkylene) monamines used in the reaction are shown in Table 2.

The resulting products produced from the reaction of the acylated copolymer backbones with various polyether monoamine functionalities are shown in Examples 7 to 26 in Table 3. Examples 7 to 26, which exemplify the lubricating oil additive composition of the present invention, were evaluated for percent viscosity increase using a soot thickening bench test, which measures the ability of the formulation to disperse and control viscosity increase resulting from the addition of carbon black, a soot surrogate. Using the soot thickening bench test, the viscosity of a fresh oil is measured in centistokes. The fresh oil is then treated with 2 wt % Vulcan XC 72R carbon black, supplied by Cabot Corporation, to form a mixture containing approximately 2 grams Vulcan XC72R carbon black and 98 grams fresh oil (test oil). The test oil, which contains carbon black, is then left to sit overnight. It is then homogenized using a high speed tissue homogenizer for approximately 60 seconds to thoroughly mix the carbon black with the fresh oil. The resulting test oil containing carbon black is then degassed at 100° C. for 30 minutes. The viscosity of the oil containing carbon black is measured according to methods that are well known in the art. The percent viscosity increase is calculated according to the following formula:

$$\%\ \text{viscosity increase}=[(\text{vis}_{cbo}-\text{vis}_{fo})/(\text{vis}_{fo})\times 100]$$

$\text{vis}_{cbo}$: viscosity of carbon black in oil $\text{vis}_{fo}$: viscosity of fresh oil Using the soot thickening bench test, the percent viscosity increase calculated for the additive compositions of Examples 7 to 26 in a formulated oil were compared to a formulated oil that does not contain the lubricating oil additive composition of the present invention. The formulated oil of the present invention comprises 0.66 wt % of an oxidation inhibitor package, 0.33 wt % pour point depressant, 4.07 wt % of a calcium based detergent package containing a phenate and sulfonates, 2.41 wt % zinc dithiophosphate, 0.03 wt % foam inhibitor, 7.7 wt % viscosity index improver and 85.10 wt % of a lube oil blend which is a mixture of basestocks that consists of 69.24 wt % Exxon150N oil, and 30.76 wt % Exxon 600N oil (all of which may be purchased from ExxonMobil Corporation, Fairfax, Va.) to provide the comparative oil formulation. To prepare the formulated lubricating oil composition of the present invention, approximately 6 wt % of the additive composition (concentrate) made from the backbone shown in Table 3 (column 2) was top treated to the formulated comparison oil. The net actives content of the additive is shown in Table 3. The results of the soot thickening bench test are shown in Table 3.

TABLE 3

Soot Thickening Bench Test Performance

| Example No. | Acylated Copolymer | Functionality | Net additive Actives Content (wt %) | Viscosity increase at 100° C., % |
|---|---|---|---|---|
| Comparative | — | — | 0 | 283.9 |
| 7 | 1 | C | 0.60 | 120.7 |
| 8 | 1 | A | 0.60 | 224.6 |
| 9 | 1 | E | 0.60 | 111.3 |
| 10 | 1 | G | 0.60 | 178.4 |
| 11 | 3 | C | 1.8 | 52.6 |
| 12 | 4a | C | 0.42 | 70.8 |
| 13 | 4a | E | 0.42 | 98.0 |
| 14 | 4a | G | 0.42 | 68.5 |
| 15 | 4a | A | 0.42 | 156.7 |
| 16 | 4b | C | 0.42 | 41.7 |
| 17 | 4b | D | 0.42 | 145.0 |
| 18 | 4c | C | 0.42 | 81.1 |
| 19 | 4d | C | 0.42 | 108.7 |
| 20 | 4e | C | 0.42 | 140.5 |
| 21 | 5 | E | 0.42 | 127.9 |
| 22 | 5 | C | 0.42 | 131.5 |
| 23 | 5 | F | 0.42 | 163.1 |
| 24 | 6 | H | 0.60 | 64.5 |
| 25 | 6 | I | 0.60 | 63.6 |
| 26 | 6 | J | 0.60 | 55.7 |

As shown in Table 3, the acylated olefin copolymers reacted with the poly(oxyalkyl) monoamines exhibits improved soot thickening performance in lubricating oil over the non-functionalized olefin copolymer used in the Comparative Example. In general, lubricating oils containing the acylated olefin copolymer reacted with poly(oxyalkyl) monoamine comprising a higher proportion of ethylene oxide to propylene oxide monomer exhibit better soot thickening performance (lower percent viscosity increase).

Examples 27-63

Wear Performance Using High Frequency Reciprocating Rig (HFRR)

Examples 27 to 63, which exemplify the lubricating oil additive composition of the present invention, were evaluated for High Frequency Reciprocating Rig (HFRR) wear bench test in presence of soot. The HFRR bench test measures the average wear scar diameter on the ball specimen after subjecting it to a reciprocating sliding motion at specified load in presence of lubricant oil pre-loaded with carbon black. The HFRR bench test was run on standard 52100 steel upper ball specimens and hardened 800HV lower disk specimens (supplied by PCS instruments). The specimens are cleaned thoroughly prior to the use. A test sample was prepared by adding 2% each of the following three carbon black (1) Degussa S-170, (2) Degussa 140V and (3) Degussa Special Black 250 to total of 6 wt % carbon black in lubricating oil. The soot laden lubricating oil was then homogenized at 17,500 rpm for 15 minutes using IKA—Ultra Turrax T25 homogenizer. The homogenized sample was then placed on a temperature controlled steel pan and a ball attached to a moveable arm was lowered into the pan. The HFRR test was run at a temperature of 116° C., load of 1000 g on the steel ball/arm assembly, stroke length of 1000 μm, and frequency of 20 Hz for 20 minutes. At the end of the run the upper specimen holder containing the ball was removed and washed with heptane. The wear scar was observed using Zeiss Microscope at 200× magnification and measured by micro hardness tester (Buehler model 1600-6400) as average of diameters in both the parallel and perpendicular to the sliding direction. The data reported in Examples 27 to 63 is the average of the three repeat measurements using the above procedure.

The wear scar diameter measured for the additive compositions of Examples 27 to 63 in formulated oil were compared to formulated oil that does not contain the lubricating oil additive composition of the present invention. The lubricating oil used in Examples 27 to 63 was a fully-formulated SAE 5W-30 lubricating oil blended with API Group III base stocks and additives including detergents, dispersants, ZDDP, anti-oxidants, an anti-foam agent, a pour point depressant, a friction modifier, a diluent process oil, the additive of the present invention, and a non-functionalized viscosity index improver. The net active content of the additive of the present invention (acylated olefin copolymer reacted with poly(oxyalkyl) monoamine) added to the lubricant oil examples are shown in Table 4. The SAE 5W-30 lubricant oil was blended to the kinematic viscosity at 100° C. of ca. 12.2+/−0.3 cSt and Cold Cranking Simulator (CCS) viscosity at −30° C. of ca. 6200+/−300 cP. The results of the HFRR wear bench test according to the invention are summarized in Table 4.

TABLE 4

HFRR Wear Performance

| Example | Acylated Copolymer | Functionality | Net Active Treat Rate in lubricating oil, wt % | Avg. Wear Scar diameter in HFRR, micron |
|---|---|---|---|---|
| Comparative | — | — | | 180 |
| 27 | 1 | C | 0.5 | 137 |
| 28 | 1 | C | 0.28 | 135 |
| 29 | 1 | C | 0.5 | 132 |
| 30 | 1 | C | 0.28 | 147 |
| 31 | 1 | A | 0.5 | 155 |
| 32 | 1 | E | 0.5 | 146 |
| 33 | 1 | G | 0.5 | 131 |
| 34 | 1 | D | 0.5 | 164 |
| 35 | 1 | F | 0.5 | 163 |
| 36 | 2 | C | 1 | 160 |
| 37 | 3 | C | 1 | 142 |
| 38 | 4a | C | 0.2 | 173 |
| 39 | 4a | C | 0.28 | 165 |
| 40 | 4a | C | 0.35 | 141 |
| 41 | 4a | C | 0.5 | 133 |
| 42 | 4a | E | 0.5 | 171 |
| 43 | 4a | G | 0.5 | 129 |
| 44 | 4a | G | 0.28 | 152 |

TABLE 4-continued

| HFRR Wear Performance | | | | |
|---|---|---|---|---|
| Example | Acylated Copolymer | Functionality | Net Active Treat Rate in lubricating oil, wt % | Avg. Wear Scar diameter in HFRR, micron |
| 45 | 4a | A | 0.5 | 170 |
| 46 | 4a | B | 0.5 | 142 |
| 47 | 4b | C | 0.5 | 135 |
| 48 | 4b | C | 0.28 | 152 |
| 49 | 4b | C | 0.28 | 160 |
| 50 | 4b | F | 0.5 | 173 |
| 51 | 4c | C | 0.5 | 151 |
| 52 | 4d | C | 0.5 | 133 |
| 53 | 4e | C | 0.5 | 135 |
| 54 | 4f | C | 0.28 | 174 |
| 55 | 4f | C | 0.5 | 144 |
| 56 | 5 | E | 0.35 | 159 |
| 57 | 5 | C | 0.35 | 159 |
| 58 | 5 | F | 0.35 | 180 |
| 59 | 4b | D | 0.28 | 180 |
| 60 | 4b | D | 0.5 | 187 |
| 61 | 6 | H | 0.28 | 139 |
| 62 | 6 | I | 0.28 | 158 |
| 63 | 6 | J | 0.28 | 154 |

Based on the data shown in Tables 3 and 4, soot thickening performance did not necessarily coincide with HFRR wear performance. However, in general, the acylated olefin copolymers reacted with poly(oxyalkyl) monoamine comprising a higher proportion of ethylene oxide to propylene oxide monomer exhibit better HFRR wear performance in lubricating oils. Usually, the poly(oxyalkyl) monoamine comprising a higher proportion of propylene oxide to ethylene oxide monomer requires more of the functionalized acylated olefin copolymer in the lubricating oil to achieve similar performance levels.

What is claimed is:

1. A method for improving diesel engine wear by lubricating the engine with a composition comprising an oil of lubricating viscosity and based upon the total composition of the lubricating oil composition from about 0.1 to about 2.0 weight % actives of a reaction product of an ethylene-alpha olefin copolymer acylated with maleic anhydride having a number average molecular weight from 5,000 to 120,000 and a hydrocarbyl-substituted poly(oxyalkylene) monoamine represented by the formula:

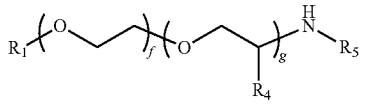

wherein:

$R_1$ a hydrocarbyl group having from about 1 to about 35 carbon atoms;

$R_4$ is independently hydrogen or methyl for each repeat unit g;

$R_5$ is hydrogen or alkyl from 1 to 10 carbon atoms; and f and g are integers such that f+g is from 2 to 45 and wherein $R_4$ is selected to have a plurality of ethylene oxide in the polyoxyalkylene moiety.

2. The method of claim 1, wherein the ethylene-alpha olefin copolymer comprises from 35 to less than 60 weight % ethylene and greater than 40 up to 65 weight % of at least one $C_3$ to $C_{28}$ alpha olefins.

3. The method of claim 2, wherein the ethylene-alpha olefin copolymer comprises from 45 to less than 55 weight % ethylene and greater than 45 up to 55 weight % of at least one $C_3$ to $C_{12}$ alpha olefins.

4. The method of claim 2, wherein the at least one $C_3$ to $C_{28}$ alpha olefins is selected from the group comprising $C_3$ to $C_8$ alpha olefins.

5. The method of claim 1, wherein the ethylene-alpha olefin copolymer comprises from 10 to less than 20 weight % ethylene and greater than 80 up to 90 weight % of propylene.

6. The method of claim 1, wherein the ethylene-alpha olefin copolymer further comprises a nonconjugated diene or triene.

7. The method of claim 1, wherein the ethylene-alpha olefin copolymer is grafted with 0.6 to 3 weight % of maleic anhydride.

8. The method of claim 1, wherein $R_1$ is selected from the group consisting of alkyl, aryl, alkyaryl, arylalkyl, and arylalkylaryl.

9. The method of claim 8, wherein $R_1$ is alkyl from 1-10 carbon atoms.

10. The method of claim 9, wherein $R_1$ is selected from the group consisting of methyl, ethyl, propyl, and butyl.

11. The method of claim 8, wherein $R_1$ is selected from the group consisting phenyl, naphthyl, alkylnapthyl and substituted phenyl having one to three substituents selected from alkyl, aryl, alkylaryl, and arylalkyl.

12. The method of claim 8, wherein $R_1$ is selected from the group consisting of phenyl, alkylphenyl, naphthyl, and alkylnaphthyl.

* * * * *